United States Patent [19]

Maxwell et al.

[11] Patent Number: 4,886,934

[45] Date of Patent: Dec. 12, 1989

[54] PROCESS FOR THE CONVERSION OF A HYDROCARBONACEOUS FEEDSTOCK

[75] Inventors: Ian E. Maxwell; Johannes K. Minderhoud, both of Amsterdam, Netherlands

[73] Assignee: Shell Oil Company, Houston, Tex.

[21] Appl. No.: 315,754

[22] Filed: Feb. 27, 1989

[30] Foreign Application Priority Data

Jun. 16, 1988 [GB] United Kingdom ..... 8814292

[51] Int. Cl.[4] ..... C07C 5/333

[52] U.S. Cl. ..... 585/660; 585/661; 208/135; 208/120; 208/59

[58] Field of Search ..... 585/660, 661; 208/135, 208/120, 59

[56] References Cited

U.S. PATENT DOCUMENTS

| | | | |
|---|---|---|---|
| 4,171,257 | 10/1979 | O'Rear et al. | 208/120 |
| 4,254,297 | 3/1981 | Frenken et al. | 585/640 |
| 4,257,874 | 3/1981 | Bergna | 585/739 |
| 4,309,275 | 1/1982 | Mulaskey | 208/134 |
| 4,309,276 | 1/1982 | Miller | 208/134 |
| 4,310,440 | 1/1982 | Wilson et al. | 252/435 |
| 4,416,766 | 11/1983 | Mulaskey | 208/135 |
| 4,440,871 | 4/1984 | Lok et al. | 502/214 |
| 4,500,651 | 2/1985 | Lok et al. | 502/208 |
| 4,727,217 | 2/1988 | Travers et al. | 585/739 |
| 4,743,354 | 5/1988 | Ward | 208/59 |
| 4,743,355 | 5/1988 | Ward | 208/59 |
| 4,773,987 | 9/1988 | Garwood | 208/59 |

FOREIGN PATENT DOCUMENTS

| | | |
|---|---|---|
| 0229295 | 7/1987 | European Pat. Off. . |
| 2110559 | 6/1983 | United Kingdom . |
| 2141733 | 1/1985 | United Kingdom . |

*Primary Examiner*—Helane Myers

*Attorney, Agent, or Firm*—Kimbley L. Muller

[57] ABSTRACT

A process is disclosed for the conversion of a hydrocarbanceous feedstock containing hydrocarbons having a boiling range wherein that an amount of hydrocarbon boils at a temperature of at least 330° C., which process comprises contacting the feedstock with a zeolitic catalyst having a pore diameter of 0.5 to 0.7 nm at a temperature of less than 480° C. and during a period of time comprising less than 10 seconds.

8 Claims, No Drawings

PROCESS FOR THE CONVERSION OF A HYDROCARBONACEOUS FEEDSTOCK

FIELD OF INVENTION

The present invention relates to a process for the conversion of a hydrocarbonaceous feedstock. Such a process has advantages when applied in the upgrading of certain feedstocks.

BACKGROUND OF INVENTION

One of such upgrading processes is the dewaxing of hydrocarbon feedstocks, such as gasoils. In GB-A No. 2,141,733, a process is described in which a hydrocarbonaceous feedstock is contacted with a shape selective catalyst in the presence of hydrogen at elevated temperature and pressure to reduce the pour point of the feedstock. In the process n-paraffins are selectively cracked thereby reducing the pour point To increase the pour point reduction ammonia and hydrogen sulphide are added to the reaction zone. The temperatures are from 232° to 538° C., the pressures are from about 8 to 208 bar, usually about 40 bar, and the liquid hourly space velocity will generally be between 0.1 to 10 $h^{-1}$.

The drawbacks of this process reside in the relatively high pressure that is to be applied and the required presence of hydrogen. Moreover it appeared that besides the desired product, i.e. dewaxed gas oil, saturated gaseous products ($C_{2-4}$) were obtained that have intrinsically low economic value.

In U.S. Pat No. 4,171,257 a process is described in which a hydrocarbonaceous feedstock is upgraded by contacting the feedstock with a ZSM-5 containing catalyst at a pressure below 14 bar, a temperature of 260° to 427° C. and a space velocity of 0.1 to 15 l/l.h. The feedstock must contain less than 5 ppmw of nitrogen-containing compounds, calculated as nitrogen. The products include olefinic hydrocarbons, such as propene and butenes.

The latter known process has as drawback that the feedstock must have been severely denitrified. This is necesserary as the more nitrogenous feedstocks would deactivate the catalyst rapidly.

OBJECTS AND EMBODIMENTS

It is an object of the invention to provide a process which is more flexible as to the feedstock, whereas the production of olefins is warranted. Surprisingly, it has been found that the dewaxing and hence the conversion of paraffins is maintained at an adequate level and the olefins are still produced if the contact time between certain zeolitic catalysts and the feedstock is below 10 seconds.

BRIEF DESCRIPTION OF INVENTION

Accordingly, the present invention provides a process for the conversion of a hydrocarbonaceous feedstock containing hydrocarbons having such a boiling range that an amount thereof boils at a temperature of at least 330° C., which process comprises contacting the feedstock with a zeolitic catalyst containing a zeolite with a pore diameter of 0.5 to 0.7 nm at a temperature of at most 480° C. and during less than 10 seconds.

DETAILED DESCRIPTION OF INVENTION

The feedstock is contacted with the zeolitic catalyst for less than 10 seconds. This short contact time warrants that hardly any thermal cracking occurs whereas the paraffins which enter the pores of the zeolitic catalyst are cracked to yield lighter products amongst which comprise a significant amount of olefins. Suitably, the minimum contact time is 0.1 second. Very good results are obtainable with a process in which the feedstock is contacted with the zeolitic catalyst during 1 to 6 seconds.

The temperature during the reaction is relatively low. The temperatures are suitably in the same order of magnitude as those applied in the processes described above. However, the temperature is significantly lower than in catalytic cracking processes where also short contact times are employed. In this respect reference is made to the Petroleum Handbook, Elsevier, 1983, p 291, where it is stated that the outlet temperature of a modern fluidized catalytic cracking reactor is from 500° to 540° C. The temperature in the present process is below 480° C. Advantageously the temperature is from 280° to 450° C., in particular from 320° to 420° C. These low temperatures render the risk of overcracking, certainly in combination with the short contact times, negligible.

The zeolitic catalyst comprises a zeolite with a pore diameter of from 0.5 to 0.7 nm. The catalyst suitably further comprises a refractory oxide that serves as binder material. Suitable refractory oxides include alumina, silica, silica-alumina, magnesia, titania, zirconia and mixtures thereof. Alumina is especially preferred. The weight ratio of refractory oxide and zeolite suitably ranges from 10:90 to 90:10, preferably from 50:50 to 85:15. The catalyst may comprise further zeolites with a pore diameter above 0.7 nm. Suitable examples of such zeolites include the faujasite-type zeolites, zeolite beta, zeolite omega and in particular zeolite X and Y. Their presence in the catalysts, however, may cause cracking of hydrocarbons which are not n-paraffinic. When, e.g. a gas oil is dewaxed, this additional cracking therefore might decrease the yield of valuable liquid product. The zeolitic catalyst thus preferably comprises as zeolite substantially only zeolites with a pore diameter of from 0.5 to 0.7 nm. Hence, preferably no zeolite with a pore diameter bigger than 0.7 nm is present in the catalyst.

The term zeolite in this specification is not to be regarded to comprise only crystalline aluminium silicates. The term also includes crystalline silica (silicalite), silicoaluminophosphates (SAPO), chromosilicates, gallium silicates, iron silicates, aluminium phosphates (ALPO), titanium aluminosilicates (TASO), boron silicates, titanium aluminophosphates (TAPO) and iron aluminosilicates.

Examples of zeolites that may be used in the process of the invention and that have a pore diameter of 0.5 to 0.7 nm, include SAPO-4 and SAPO-11, which are described in U.S. Pat. No. 4,440,871, ALPO-11, described in U.S. Pat. No. 4,310,440, TAPO-11, described in U.S. Pat. No. 4,500,651, TASO-45, described in EP-A No. 229,295, boron silicates, described in e.g. U.S. Pat. No. 4,254,297, aluminium silicates like erionite, ferrierite, theta and the ZSM-type zeolites such as ZSM-5, ZSM-11, ZSM-12, ZSM-35, ZSM-23, and ZSM-38. Preferably the zeolite is selected from the group consisting of crystalline metal silicates having a ZSM-5 structure, ferrierite, erionite and mixtures thereof. Suitable examples of crystalline metal silicates with ZSM-5 structure are aluminium, gallium, iron, scandium, rhodium and/or scandium silicates as described in e.g. GB-B No. 2,110,559.

During the preparation of the zeolites usually a significant amount of alkali metal oxide is present in the readily prepared zeolite. Preferably the amount of alkali metal is removed by methods known in the art, such as ion exchange, optionally followed by calcination, to yield the zeolite in its hydrogen form. Preferably the zeolite used in the present process is substantially in its hydrogen form.

Olefin production is facilitated by the absence of hydrogen or a hydrogen donor. Hence, the present process is advantageously carried out in the absence of added hydrogen and/or steam. It is, of course, possible that during the reaction some small molecules, such as hydrogen molecules are formed. However, this amount is usually negligible and will be less than 0.5% wt of the product.

The pressure in the present process can be varied within wide ranges. It is, however, preferred that the pressure is such that at the prevailing temperature the feedstock is substantially in its gaseous phase. Then it is easier to achieve the short contact times envisaged. Hence, the pressure is preferably relatively low. This is the more advantageous since no expensive compressors and high-pressure vessels and other equipment is necessary. The pressure is preferably up to 10 bar. Subatmospheric pressures are possible, but not preferred. The minimum pressure is suitably 1 bar. It is economically advantageous to operate at atmospheric pressure.

The catalyst/feedstock weight ratio again is not critical. Preferably, the weight ratio varies from 1 to 25 kg of catalyst per kg of feedstock. More preferred, the catalyst/feedstock weight ratio is from 2 to 10.

The process according to the present invention may be carried out in a fixed bed. However, this would imply that extremely high space velocities be required to attain the short contact times envisaged. Therefore, the present process is preferably carried out in a moving bed. The bed of catalyst may move upwards or downwards. When the bed moves upwards a process similar to a fluidized catalytic cracking process is obtained. Preferably, the process is carried out in a downwardly moving bed.

During the process some coke may be formed on the catalyst. Therefore, it would be advantageous to regenerate the catalyst. Preferably the catalyst is regenerated by subjecting it after having been contacted with the feedstock to a treatment with an oxidizing gas, such as air. A continuous regeneration, similar to the regeneration carried out in a fluidized catalytic cracking process, is especially preferred.

The coke formation does not occur at a very high rate. Hence, it would be possible to arrange for a process in which the residence time of the catalyst particles in a reaction zone, e.g. a moving bed, is longer than the residence time of the feedstock in the reaction zone. Of course the contact time between feedstock and catalyst should be less than 10 seconds. The contact time generally corresponds with the residence time of the feedstock. Suitably the residence time of the catalyst is from 1 to 20 times the residence time of the feedstock.

The feedstock which is to be converted in the present process comprises hydrocarbons which have a boiling point of at least 330° C. By means of this feature relatively light petroleum fractions, such as naphtha and kerosene, have been excluded. Preferably the feedstock has such a boiling range that at least 50% wt thereof boils at a temperature of 330° C. Suitable feedstocks include vacuum distillates, long residues, deasphalted residual oils and atmospheric distillates which fulfil the requirement as to boiling range, such as gas oils. Preferably, the feedstock is a gas oil or vacuum gas oil. When these feedstocks are subjected to the present process a gas oil with a very low pour point and an olefin-rich gaseous fraction are obtained.

One of the advantages of the present invention over the process according to U.S. Pat. No. 4,171,257 resides in the fact that a feedstock with a relatively high nitrogen content may be used with substantially no effect on the catalyst activity. Suitable feedstocks may have a nitrogen content of more than 25 ppmw, calculated as nitrogen. The feedstock may even have a nitrogen content of 100 to 1000 ppmw, calculated as nitrogen.

Another advantage of the present process according to the prior art resides in the fact that the residence time of the feedstock in the present process is relatively short, and that therefore the relative throughput in the present process can be higher than in the prior art process.

The present invention will be further illustrated by means of the following example:

EXAMPLE

In a series of experiments a dewaxing process was carried out using a gas oil having the following properties:

| | |
|---|---|
| IBP, °C. | 213 |
| 20% wt | 331 |
| 50% wt | 379 |
| 90% wt | 421 |
| FBP | 448 |
| pour point, °C. | 19.5 |
| flash point, °C. | 147 |
| carbon, % wt | 86.6 |
| hydrogen, % wt | 13.1 |
| sulphur, % wt | 0.3 |
| nitrogen, ppmw | 330 |

The gas oil was dewaxed in a down flow reactor in which co-currently a flow of feedstock and catalyst particles, having an average particle size of 74 micrometers, was passed downwards. The catalyst used comprised ZSM-5 in an alumina matrix (weight ratio ZSM-5/alumina was 1.3). All experiments were carried out at atmospheric pressure. Further process conditions and the results of the experiments are indicated in the table below.

TABLE

| Experiment No. | 1 | 2 | 3 | 4 | 5 | 6 |
|---|---|---|---|---|---|---|
| Temperature, °C. | 400 | 400 | 400 | 400 | 380 | 350 |
| Catalyst/oil ratio, kg/kg | 6.1 | 6.8 | 7.4 | 4.2 | 6.5 | 8.6 |
| Contact time, s | 2.2 | 1.7 | 3.9 | 3.8 | 2.0 | 2.5 |
| Product, % w | | | | | | |
| Gas ($C_{1-4}$) | 14.6 | 13.3 | 10.7 | 9.8 | 13.7 | 9.6 |
| Gasoline ($C_5$—221 °C.) | 11.9 | 11.1 | 12.9 | 11.3 | 12.3 | 11.6 |
| Gas oil ($221^{30}$ °C.) | 72.1 | 74.1 | 73.6 | 76.3 | 69.8 | 76.4 |
| Coke on catalyst | 1.4 | 1.4 | 2.8 | 2.6 | 4.2 | 2.4 |
| Gas oil pour point, °C. | −51 | −45 | −51 | −48 | n.d. | n.d. |
| Gas (in total product), % w | | | | | | |
| $C_2^-$ | 0.6 | 0.6 | 0.7 | 0.3 | 0.5 | 0.4 |
| $C_3$ | 5.3 | 4.9 | 4.1 | 3.4 | 4.8 | 2.9 |
| $C_4$ | 8.7 | 7.8 | 5.9 | 6.1 | 8.5 | 6.3 |
| Unsaturation | | | | | | |
| $C_3^=/C_3$ | 3.1 | 3.9 | 3.1 | 2.8 | 2.8 | 3.5 |

TABLE-continued

| Experiment No. | 1 | 2 | 3 | 4 | 5 | 6 |
|---|---|---|---|---|---|---|
| $C_4^{=}/C_4$ | 1.7 | 3.3 | 2.1 | 2.1 | 2.0 | 2.9 |

n.d = not determined

The $C_2^-$ fraction in the product consisted essentially of ethylene with hardly an ethane or methane.

From the results of the above experiments it is evident that the gas oil obtained has an excellent pour point, whereas the majority of the gaseous products obtained is olefinically unsaturated.

What I claim as my invention is:

1. In a process for the conversion of paraffins contained in a gas oil or a vacuum gas oil to olefins wherein said gas oil or vacuum gas oil has a nitrogen content of at least 25 ppmw and at least 50 percent of said gas oil or vacuum gas oil boils at a temperature of 330° C. or greater which process comprises contacting said gas oil or vacuum gas oil with a zeolite catalyst having a pore diameter of 0.5 to 0.7 nm at a temperature of from 280° to 450° C., a pressure of from 1 to 10 bar, a catalyst to feedstock weight ratio of from 1 to 25 over a period of time, the improvement which consists of limiting the time of contact of the gas oil or vacuum gas oil with the catalyst to from 0.1 to less than 10 seconds.

2. The process of claim 1, wherein said period of time comprises from 1 to 6 seconds.

3. The process of claim 1, wherein said temperature is maintained in the range of from 320° to 420° C.

4. The process of claim 1, wherein said zeolite catalyst is selected from group consisting of ZSM-5, ferrierite, erionite and mixtures thereof.

5. The process of claim 1, wherein said zeolite is in the substantially hydrogen form.

6. The process of claim 1, wherein said process is performed in the absence of hydrogen or steam.

7. The process of claim 1, wherein said process is performed at a catalyst/feedstock weight ratio of from 2 to 10.

8. The process of claim 1, wherein said process is performed in a downwardly moving bed.

* * * * *